US011805371B1

(12) United States Patent
Yang et al.

(10) Patent No.: US 11,805,371 B1
(45) Date of Patent: Oct. 31, 2023

(54) PIEZOELECTRIC MEMS MICROPHONE CHIP AND PIEZOELECTRIC MEMS MICROPHONE

(71) Applicant: Wuhan MEMSonics Technologies Co., Ltd., Hubei (CN)

(72) Inventors: Chaoxiang Yang, Hubei (CN); Bohao Hu, Hubei (CN); Wenjuan Liu, Hubei (CN); Chengliang Sun, Hubei (CN); Bowoon Soon, Singapore (SG)

(73) Assignee: Wuhan MEMSonics Technologies Co., Ltd., Wuhan (CN)

( * ) Notice: Subject to any disclaimer, the term of this patent is extended or adjusted under 35 U.S.C. 154(b) by 0 days.

(21) Appl. No.: 18/201,174

(22) Filed: May 23, 2023

(30) Foreign Application Priority Data

May 24, 2022 (CN) ..... 202210565797.4

(51) Int. Cl.
*H04R 1/00* (2006.01)
*H04R 17/02* (2006.01)
(Continued)

(52) U.S. Cl.
CPC ..... *H04R 17/02* (2013.01); *H04R 1/06* (2013.01); *H04R 3/00* (2013.01); *H04R 2201/003* (2013.01)

(58) Field of Classification Search
CPC ... H04R 1/00; H04R 1/02; H04R 1/04; H04R 1/06; H04R 1/08; H04R 1/083; H04R 1/28; H04R 3/00; H04R 7/16; H04R 7/18; H04R 7/20; H04R 9/02; H04R 9/08; H04R 17/00; H04R 17/02; H04R 19/00; H04R 19/04; H04R 2201/003; B81B 3/00; B81B 3/0021; B81B 7/00; B81B 7/008; B81B 2201/0257
See application file for complete search history.

(56) References Cited

U.S. PATENT DOCUMENTS 6,857,501 B1 * 2/2005 Han ..... H04R 17/00 29/594
10,999,684 B1 * 5/2021 Wan ..... H04R 17/02
(Continued)

FOREIGN PATENT DOCUMENTS

CN 208987175 U 6/2019
CN 110545511 A 12/2019
(Continued)

*Primary Examiner* — Thang V Tran
(74) *Attorney, Agent, or Firm* — Gang Yu

(57) ABSTRACT

The present application discloses a piezoelectric micro electrical mechanical system (MEMS) microphone chip and a piezoelectric MEMS microphone, and relates to the technical field of piezoelectric devices. The piezoelectric MEMS microphone chip includes at least one substrate frame and at least one plurality of sound receiving beams arranged on the substrate frame. Each of the sound receiving beams includes a connecting beam and a cantilever beam. The connecting beam and the cantilever beam are staggered on a circumference. One ends of the plurality of sound receiving beams that face a geometric center of the a circumference are fixedly connected to one another in a center defined by the substrate frame, and one end of the connecting beam that is away from the geometric center is fixedly connected to the substrate frame.

20 Claims, 4 Drawing Sheets

(51) Int. Cl.
*H04R 1/06* (2006.01)
*H04R 3/00* (2006.01)

(56) References Cited

U.S. PATENT DOCUMENTS

| | | | | |
|---|---|---|---|---|
| 11,159,893 | B1 | 10/2021 | Kervran | |
| 2018/0198384 | A1 | 7/2018 | Jia et al. | |
| 2019/0327562 | A1* | 10/2019 | Cerini | H04R 31/00 |
| 2020/0382876 | A1* | 12/2020 | Cerini | H04R 17/02 |
| 2022/0402751 | A1* | 12/2022 | Chen | H04R 17/02 |
| 2023/0143656 | A1* | 5/2023 | Littrell | H04R 17/02 257/415 |
| 2023/0270012 | A1* | 8/2023 | Littrell | H04R 17/02 310/357 |

FOREIGN PATENT DOCUMENTS

| | | | | | |
|---|---|---|---|---|---|
| CN | 110602616 | A | | 12/2019 | |
| CN | 111328005 | A | * | 6/2020 | H04R 17/02 |
| CN | 211378248 | U | | 8/2020 | |
| CN | 112423210 | A | * | 2/2021 | H04R 19/04 |
| CN | 212572963 | U | | 2/2021 | |
| WO | WO-2014119609 | A1 | * | 8/2014 | G01C 19/56 |
| WO | 2020249457 | A1 | | 12/2020 | |

* cited by examiner

PIEZOELECTRIC MEMS MICROPHONE CHIP AND PIEZOELECTRIC MEMS MICROPHONE

CROSS-REFERENCE TO RELATED APPLICATION

This patent application claims the priority of Chinese Patent Application No.

CN202210565797.4, entitled "Piezoelectric MEMS Microphone Chip And Piezoelectric MEMS Microphone" filed on May 24, 2022, the disclosure of which is incorporated by reference herein in its entirety.

TECHNICAL FIELD

The present application relates to the technical field of piezoelectric devices, in particular, to a piezoelectric micro electrical mechanical system (MEMS) microphone chip and a piezoelectric MEMS microphone.

BACKGROUND

A microphone is an energy conversion device capable of converting sound signals into electrical signals in different ways. A piezoelectric micro-electromechanical system (MEMS) microphone is an energy conversion device for converting sound signals into electrical signals by using a piezoelectric effect. In recent years, piezoelectric MEMS microphones have been widely used in smart wearable devices and smart phones due to their advantages of small size, stable performance, high signal-to-noise ratio, good sensitivity, and fast response. Most common piezoelectric MEMS microphones are of a cantilever beam structure capable of avoiding the influence of a residual stress caused by a circular vibrating diaphragm structure and improving the output of piezoelectric microphone devices.

In the prior art, in a piezoelectric microphone of a cantilever beam structure, electrodes are generally arranged at positions of cantilever beams that are close to fixed ends, due to that when the cantilever beams are bent and vibrate, a larger stress is generated at the positions close to the fixed ends to produce more induced charges; and electrodes connected to a circuit are generally not arranged at other positions of the cantilever beams that have smaller stress, resulting in a waste of the vibrating diaphragm area of the device. most cantilever beams are peripherally fixed, but such fixing method leads to low sensitivity of the cantilever beams. Piezoelectric microphones with centrally fixed cantilever beams have higher output voltage and better sensitivity, but the centrally fixed cantilever beams have poor stability, which is easy to cause damage to support substrates of the cantilever beams, and is not conducive to subsequent wire leading operation of devices.

SUMMARY

Embodiments of the present application are implemented as follows:

One aspect of the embodiments of the present application provides a piezoelectric MEMS microphone chip, including a substrate frame and a plurality of sound receiving beams arranged on the substrate frame, where each of the sound receiving beams includes at least one connecting beam and at least one cantilever beam, the connecting beam and the cantilever beam are staggered on a circumference, one ends of the plurality of sound receiving beams that face a geometric center of the a circumference are fixedly connected to one another in a center defined by the substrate frame, and one end of the connecting beam that is away from the geometric center is fixedly connected to the substrate frame.

In some embodiments, sector angles formed by two side edges of each of the sound receiving beams that face the geometric center are same.

In some embodiments, electrodes are arranged on one side of the connecting beam that is close to an edge of the substrate frame and the other side of the connecting beam that is close to the geometric center, respectively, the electrodes on the two sides of the connecting beam are not connected to each other, and an electrode is arranged on one side of the cantilever beam that faces the geometric center.

In some embodiments, sector angles formed by two side edges of each of the sound receiving beams that face the geometric center are different.

In some embodiments, sector angles formed by two side edges of each of the cantilever beams that face the geometric center are same, and sector angles formed by two side edges of each of the connecting beams that face the geometric center are same and are smaller than the sector angles formed by the two side edges of each of the cantilever beams that face the geometric center.

In some embodiments, sector angles formed by two side edges of each of the plurality of cantilever beams that face the geometric center are different, and lengths of the plurality of cantilever beams are different.

In some embodiments, a spacing distance between adjacent two of the connecting beams is equal.

In some embodiments, the plurality of cantilever beams are arranged between adjacent two of the connecting beams.

In some embodiments, the sound receiving beams are of a piezoelectric unimorph structure or a piezoelectric bimorph structure.

In some embodiments, there are eight sound receiving beams, and sector angles formed by two side edges of a valve of each of the eight sound receiving beams that face the geometric center are same.

In some embodiments, there are even numbers of connecting beams arranged opposite to each other in pairs.

In some embodiments, there are four connecting beams and four cantilever beams, and the connecting beams and the cantilever beams are staggered.

In some embodiments, the substrate frame is polygonal, and shapes of the plurality of sound receiving beams are trapezoids with a same area.

In some embodiments, the substrate frame is circular, and shapes of the plurality of sound receiving beams are sectors with a same area.

In some embodiments, the sound receiving beams are of the piezoelectric unimorph structure that comprises an upper electrode, a piezoelectric film, and a lower electrode in sequence from top to bottom.

In some embodiments, the sound receiving beams are of the piezoelectric bimorph structure that comprises an upper electrode, an upper piezoelectric film, a middle electrode, a lower piezoelectric film, and a lower electrode in sequence from top to bottom.

Another aspect of the embodiments of the present application provides a piezoelectric MEMS microphone, including a substrate, an application specific integrated circuit (ASIC) chip arranged on the substrate, and any one of the piezoelectric MEMS microphone chips as described above, where the piezoelectric MEMS microphone chip is arranged on the substrate and is connected to the ASIC chip through at least one lead wire.

In some embodiments, the piezoelectric MEMS microphone chip comprises a substrate frame and a plurality of sound receiving beams arranged on the substrate frame, each of the sound receiving beams comprises a connecting beam and a cantilever beam, and sector angles formed by two side edges of each of the sound receiving beams that face a geometric center are same.

In some embodiments, electrodes are arranged on one side of the connecting beam that is close to an edge of the substrate frame and the other side of the connecting beam that is close to the geometric center, respectively, some electrodes on the two sides of the connecting beam are connected to each other, while the other electrodes are not, and at least one group of electrodes is arranged on one side of the cantilever beam that faces the geometric center.

In some embodiments, sector angles formed by two side edges of each of the sound receiving beams that face the geometric center are different.

BRIEF DESCRIPTION OF THE DRAWINGS

To more clearly illustrate the technical solutions in the embodiments of the present application, the accompanying drawings that need to be used in the embodiments will be briefly introduced below. It should be understood that the accompanying drawings below merely illustrate some embodiments of the present application and therefore should not be regarded as limiting the scope. Those of ordinary skill in the art may also derive other related accompanying drawings from these accompanying drawings without creative efforts.

Reference signs: 100—piezoelectric MEMS microphone chip; 110—substrate frame; 120—sound receiving beam; 121—connecting beam; 1211—first fixed end; 1212—second fixed end; 122—cantilever beam; 1221—third fixed end; 1222—free end; 123—electrode; 130—piezoelectric bimorph; 131—seed layer; 132—bottom electrode; 133—lower layer piezoelectric material; 134—middle electrode; 135—upper layer piezoelectric material; 136—top electrode; 200—piezoelectric MEMS microphone; 210—substrate plate; and 220—application specific integrated circuit (ASIC) chip.

DETAILED DESCRIPTION OF THE EMBODIMENTS

To make the objectives, technical solutions and advantages of the embodiments of the present application clearer, the technical solutions in the embodiments of the present application will be clearly and completely described below with reference to the accompanying drawings in the embodiments of the present application. Apparently, the described embodiments are a part rather than all of the embodiments of the present application. The components in the embodiments of the present application, which are generally described and shown in the accompanying drawings herein, may be arranged and designed in various different configurations.

Therefore, the following detailed descriptions of the embodiments of the present application provided in the accompanying drawings are not intended to limit the scope of protection of the present application, and only represents the selected embodiments of the present application. All other embodiments obtained by those of ordinary skill in the art based on the embodiments of the present application without creative efforts shall fall within the scope of protection of the present application.

It should be noted that similar reference signs and letters represent similar items in the following accompanying drawings. Therefore, once an item is defined in an accompanying drawing, it is not required to be further defined and explained in the subsequent accompanying drawings. In addition, the terms "first", "second", "third" and the like are only used for distinguishing descriptions, and cannot be understood as indicating or implying relative importance.

In the description of the present application, it should be further noted that the terms "arranged", "mounted", "connected", and "connection" should be understood in a broad sense, unless otherwise expressly specified and limited. For example, the "connection" may be fixed connection, detachable connection, or integrated connection, and may be mechanical connection or electrical connection; and the "connected" may be directly connected, indirectly connected by an intermediate medium, or internal communication between two elements. Those of ordinary skill in the art may understand specific meanings of the above terms in the present application according to specific circumstances.

Figure 1:
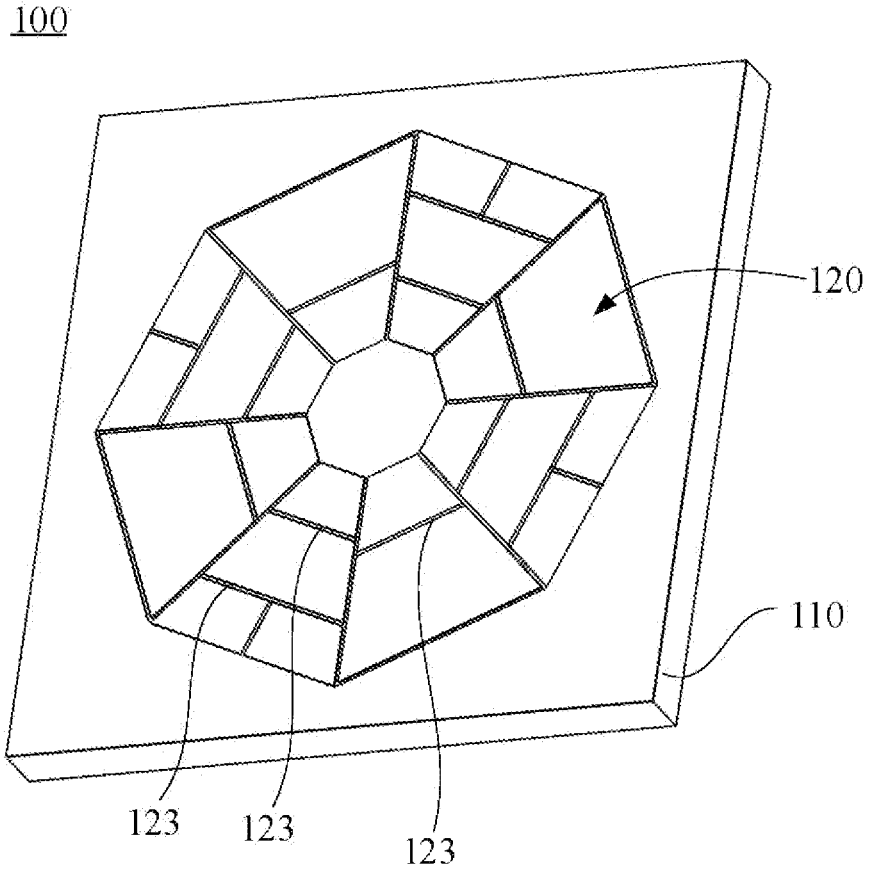
FIG. 1 is a first schematic structural diagram of a piezoelectric micro electrical mechanical system (MEMS) microphone chip provided by an embodiment of the present application.
Figure 2:
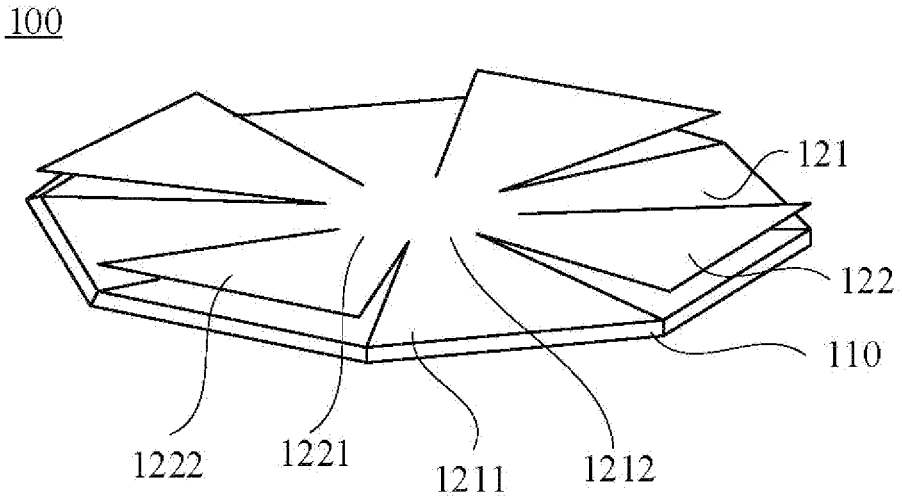
FIG. 2 is a second schematic structural diagram of a piezoelectric MEMS microphone chip provided by an embodiment of the present application.
Figure 3:
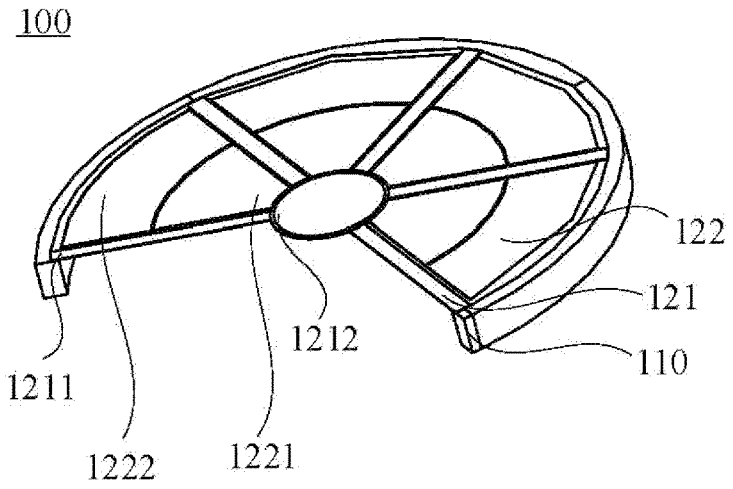
FIG. 3 is a third schematic structural diagram of a piezoelectric MEMS microphone chip provided by an embodiment of the present application.
Figure 4:
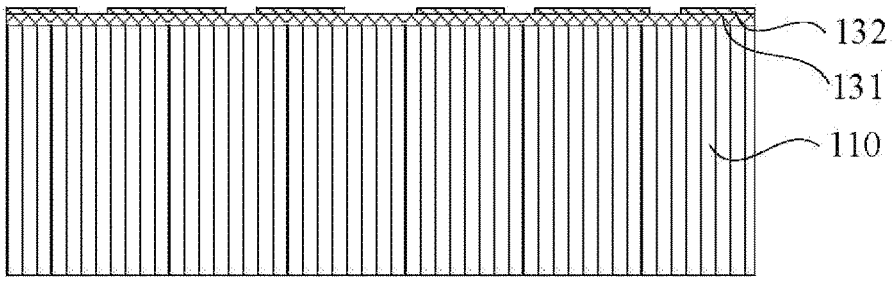
FIG. 4 is a first flowchart of a method for fabricating a piezoelectric MEMS microphone chip provided by an embodiment of the present application.
Figure 5:
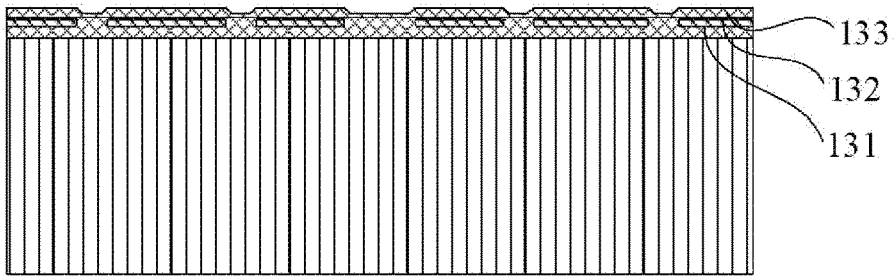
FIG. 5 is a second flowchart of a method for fabricating a piezoelectric MEMS microphone chip provided by an embodiment of the present application.
Figure 6:
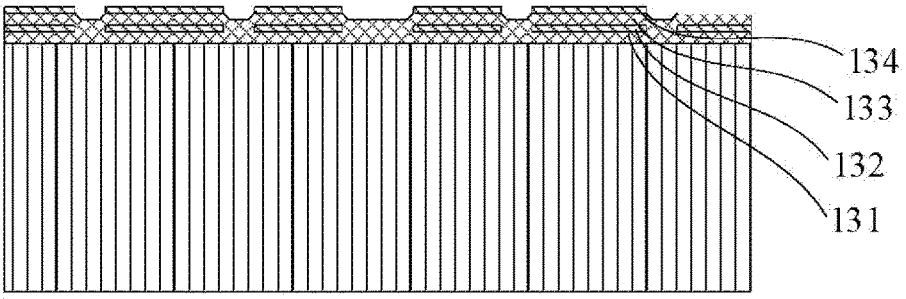
FIG. 6 is a third flowchart of a method for fabricating a piezoelectric MEMS microphone chip provided by an embodiment of the present application.
Figure 7:
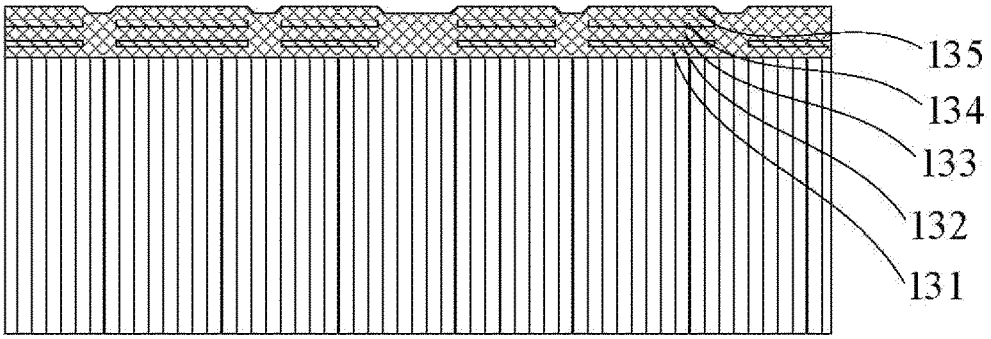
FIG. 7 is a fourth flowchart of a method for fabricating a piezoelectric MEMS microphone chip provided by an embodiment of the present application.
Figure 8:
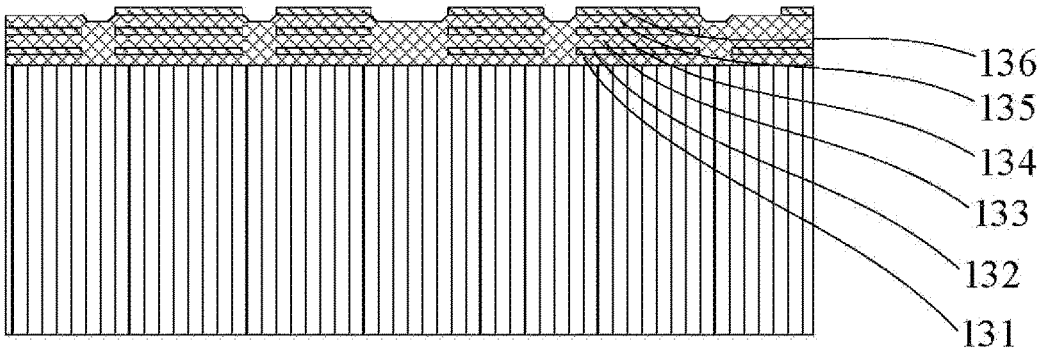
FIG. 8 is a fifth flowchart of a method for fabricating a piezoelectric MEMS microphone chip provided by an embodiment of the present application.
Figure 9:
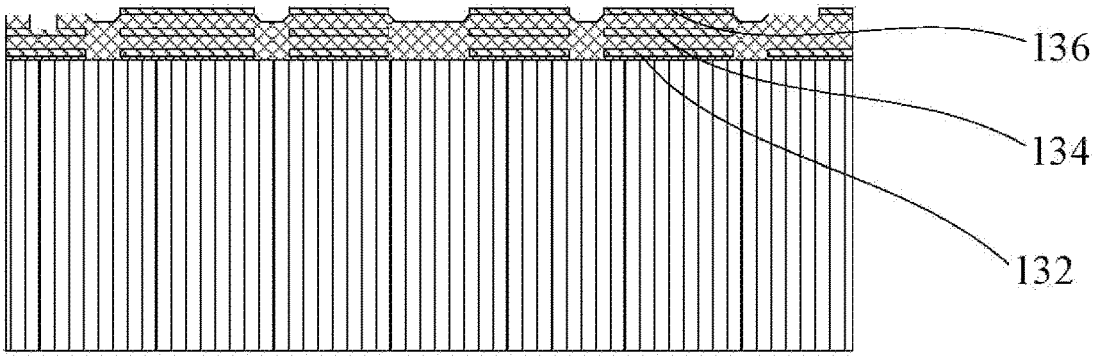
FIG. 9 is a sixth flowchart of a method for fabricating a piezoelectric MEMS microphone chip provided by an embodiment of the present application.
Figure 10:
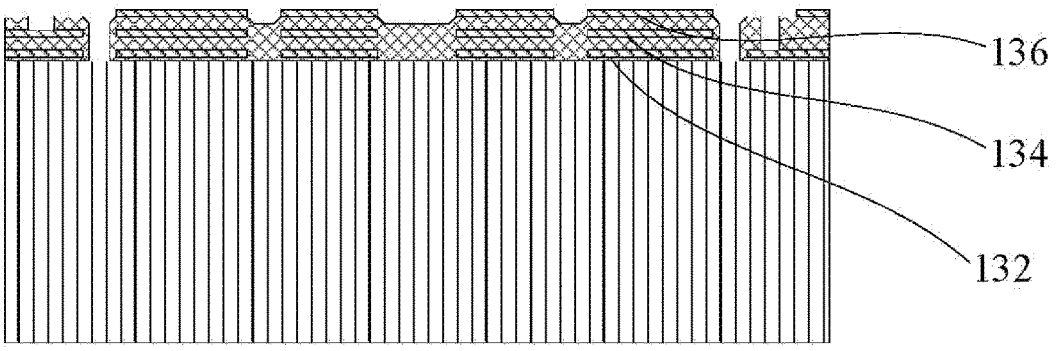
FIG. 10 is a seventh flowchart of a method for fabricating a piezoelectric MEMS microphone chip provided by an embodiment of the present application.
Figure 11:
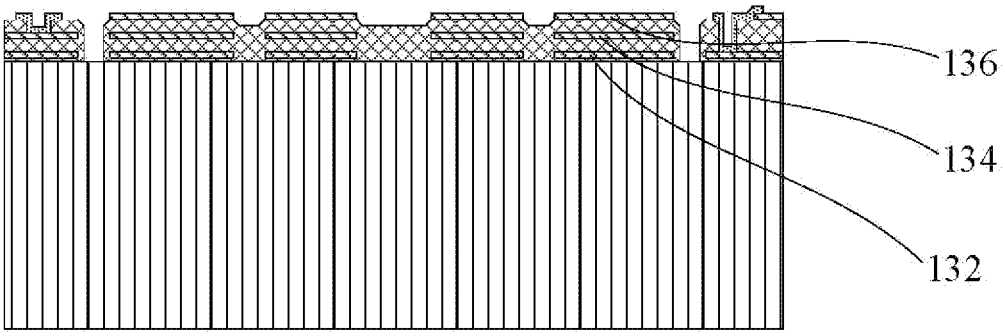
FIG. 11 is an eighth flowchart of a method for fabricating a piezoelectric MEMS microphone chip provided by an embodiment of the present application.
Figure 12:
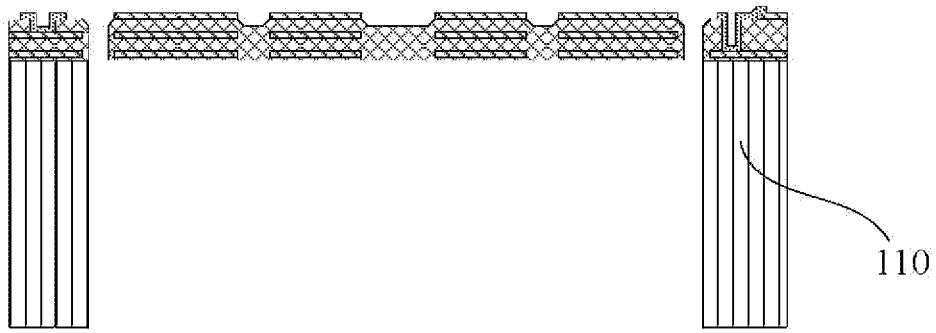
FIG. 12 is a ninth flowchart of a method for fabricating a piezoelectric MEMS microphone chip provided by an embodiment of the present application.

Referring to FIG. 1 to FIG. 3, this embodiment provides a piezoelectric micro electrical mechanical system (MEMS) microphone chip 100, including a substrate frame 110 and a plurality of sound receiving beams 120 arranged on the substrate frame 110, where each of the sound receiving beams 120 includes a connecting beam 121 and a cantilever beam 122, the connecting beam 121 and the cantilever beam 122 are staggered on a circumference, one ends of the plurality of sound receiving beams 120 that face a geometric center of the a circumference are fixedly connected to one another in a center defined by the substrate frame 110, and one end of the connecting beam 121 that is away from the geometric center is fixedly connected to the substrate frame 110.

Specifically, when the piezoelectric MEMS microphone chip 100 is fabricated, an entire vibrating diaphragm is fixed to the substrate frame 110, and the plurality of sound receiving beams 120 are formed by means of etching; two ends of the connecting beam 121 are connected and fixed, and one end of the cantilever beam 122 is fixed; the connecting beam 121 includes a first fixed end 1211 connected to the substrate frame 110 and a second fixed end 1212 away from the first fixed end 1211, and the cantilever beam 122 includes a third fixed end 1221 facing the geometric center and a free end 1222 away from the third fixed end 1221; and when a sound wave signal is propagated to a microphone through air and other media, vibration of the free end 1222 of the cantilever beam 122 is caused at a sound pressure receiving region, hetero charges are generated on upper and lower surfaces of a piezoelectric film due to a positive piezoelectric effect, and an electrical signal is led out through the bottom electrode and the top electrode. The second fixed ends 1212 of the plurality of connecting beams 121 and the third fixed ends 1221 of the plurality of cantilever beams 122 are connected to each other. The entire vibrating diaphragm is pulled by the connecting beams 121, which ensures the connection strength of the entire vibrating diaphragm. The electrodes on the cantilever beams 122 are led out to the connecting beams 121, and the connecting electrodes are led out and connected to the peripherally fixed substrate frame 110 by the connecting beams 121, which ensures the support strength of the substrate frame 110, to facilitate wire bonding operation. Meanwhile, in a structural form of such piezoelectric cantilever beams 122, an area of the free ends 1222 is large. Under the condition that an area of the sound pressure receiving region remains unchanged, compared with peripherally fixed piezoelectric cantilever beams, a same sound pressure makes the piezoelectric cantilever beams 122 more flexible, and generated electrical signals are larger.

The piezoelectric MEMS microphone chip 100 provided by the present application includes the substrate frame 110 and the plurality of sound receiving beams 120 arranged on the substrate frame 110, where the sound receiving beams 120 includes the connecting beam 121 and the cantilever beam 122, the connecting beam 121 and the cantilever beam 122 are staggered on the circumference, one ends of the plurality of sound receiving beams 120 that face the geometric center are fixedly connected to one another in the center defined by the substrate frame 110, and one end of the connecting beam 121 that is away from the geometric center is fixedly connected to the substrate frame 110. Compared with a peripheral fixing mode, the cantilever beam 122 in the present application has higher sensitivity. Compared with an intermediately fixing mode, in the present application, the plurality of connecting beams 121 are fixedly connected to the substrate frame 110, which can improve the fixing stability of the cantilever beams 122, and also enhances the output sensitivity of the piezoelectric microphone.

In a feasible embodiment of the present application, as shown in FIG. 2 and FIG. 3, sector angles formed by two side edges of each of the sound receiving beams 120 that face the geometric center are same.

Specifically, the sector angles formed by the two side edges of each of the plurality of sound receiving beams 120 that face the geometric center are same, equivalently, sector angles formed by two side edges of the second fixed end 1212 of each of the plurality of connecting beams 121 that face the geometric center are as same as sector angles formed by the two side edges of the third fixed end 1221 of each of the plurality of cantilever beams 122 that face the geometric center, the cantilever beams 122 and the connecting beams 121 can work as sound receiving units, and the connecting beams 121 not only connect the entire vibrating diaphragm, but also absorb vibration.

A first-order vibration mode of the vibrating diaphragm is dominated by the centrally fixed cantilever beams 122, while a second-order vibration mode of the vibrating diaphragm is jointly dominated by the plurality of sound receiving beams 120. When the vibrating diaphragm is in the second-order vibration mode, the connecting beams 121 and the cantilever beams 122 vibrate together, equivalently, a length of the cantilever beams 122 is increased, thereby improving the sound receiving sensitivity of the piezoelectric MEMS microphone.

For example, when the number of sound receiving beams 120 is set to be eight, sector angles formed by two side edges of each of valves of the eight sound receiving beams 120 that face the geometric center are same, where the number of connecting beams 121 is set to be four, and the number of cantilever beams 122 is set to be four; the connecting beams 121 and the cantilever beams 122 are staggered at intervals, the four connecting beams 121 pull and connect the entire vibrating diaphragm, and the area of the free ends 1222 of the four cantilever beams 122 is large; and under the condition that the area of the sound pressure receiving region remains unchanged, compared with the peripherally fixed device, the same sound pressure makes the piezoelectric cantilevers 122 more flexible, the generated electrical signals are larger, and the sensitivity of the piezoelectric microphone is higher.

When the substrate frame 110 is a polygon, the plurality of sound receiving beams 120 are trapezoidals with a same size, and when the substrate frame 110 is a circle, the plurality of sound receiving beams 120 are sectors with a same size, to ensure the support strength and sensitivity of the piezoelectric microphone.

In a feasible embodiment of the present application, as shown in FIG. 1, electrodes 123 are arranged on one side of the connecting beam 121 that is close to the substrate frame 110 and the other side of the connecting beam that is close to the geometric center, respectively, some electrodes 123 on the two sides of the connecting beam 121 are connected to each other, while the others are not, and an electrode 123 is arranged on one side of the cantilever beam 122 that faces the geometric center.

Specifically, stress concentration regions are provided on one side of the connecting beam that is close to the substrate frame 110 and the other side of the connecting beam that is close to the geometric center, and a stress concentration region is provided on one side of the cantilever beam 122 that faces the geometric center. According to a piezoelectric theory, the larger a stress is, the more generated electric charges are. Therefore, when the electrode 123 is arranged in a region with a larger stress, more electric charge signals may be picked up, thus improving the sound receiving sensitivity of the piezoelectric MEMS microphone. Further, two groups of electrodes 123 may be arranged on one side of the connecting beam 121 that is close to the substrate frame 110, and two groups of electrodes 123 may be arranged on one side of the cantilever beam 122 that faces the geometric center, which further improves the sound receiving sensitivity of the piezoelectric MEMS microphone.

In a feasible embodiment of the present application, as shown in FIG. 2 and FIG. 3, sector angles formed by two side edges of each of the sound receiving beams 120 that face the geometric center are different.

Further, sector angles formed by two side edges of each of the cantilever beams that face the geometric center are same, and sector angles formed by two side edges of each of the connecting beams that face the geometric center are same and are smaller than the sector angles formed by the two side edges of each of the cantilever beams that face the geometric center.

Specifically, the entire vibrating diaphragm is pulled and fixed by the connecting beams 121, and an area of the cantilever beams 122 is larger than an area of the connecting beams 121, which increases the area of the free ends 1222 of the cantilever beams 122 on the basis of ensuring the connecting stability of the entire vibrating diaphragm, thus enhancing the sensitivity of the piezoelectric MEMS microphone.

In a feasible embodiment of the present application, as shown in FIG. 2 and FIG. 3, sector angles formed by two side edges of each of the plurality of cantilever beams 122 that face the geometric center are different, and lengths of the plurality of cantilever beams 122 are different.

Specifically, sector angles formed by two side edges of the third fixed end 1221 of each of the cantilever beams 122 that face the geometric center are set to be different, so that the −3 dB bandwidth of the device will increase, and the sound receiving sensitivity of the piezoelectric MEMS microphone can be improved; and when the sector angles formed by the two side edges of each of the cantilever beams 122 that face the geometric center are larger, the sensitivity of the piezoelectric MEMS microphone is higher.

For example, a plurality of cantilever beams 122 with an angle of 10° may be arrayed, a plurality of cantilever beams 122 with an angle of 20° may be arrayed, and a plurality of cantilever beams 122 with an angle of 30° may be arrayed, so that the cantilever beams 122 may more sensitive to the sounds at the different frequency bands, thus enhancing the sensitivity of the piezoelectric MEMS microphone. Understandably, the cantilever beams 122 with the different lengths may be arrayed, so that the cantilever beams 122 may more sensitive to the sounds at the different frequency bands, thus enhancing the sensitivity of the piezoelectric MEMS microphone.

In a feasible embodiment of the present application, as shown in FIG. 2 and FIG. 3, a spacing distance between adjacent two of the connecting beams 121 is equal.

Specifically, the entire vibrating diaphragm is fixed to the substrate frame 110 through the connecting beams 121, and the plurality of connecting beams 121 are arrayed, to enhance the connection between the entire vibrating diaphragm and the substrate frame 110. At this time, the cantilever beams 122 are arrayed between the two adjacent connecting beams 121, which not only ensures the sensitivity of the cantilever beams 122 of the piezoelectric MEMS microphone, but also ensures that the substrate frame 110 can support the entire vibrating diaphragm through the plurality of connecting beams 121 arrayed.

Further, when the sector angles formed by the two side edges of each of the plurality of connecting beams 121 that face the geometric center are 0°, the area of the free ends 1222 of the plurality of cantilever beams 122 is maximum and the sensitivity is highest. At this time, the connecting beams 121 mainly function to pull and fix the entire vibrating diaphragm, so that the vibrating diaphragm is fixedly connected to the substrate frame 110.

Further, the number of connecting beams 121 may be set to be even, and every two of the connecting beams 121 are arranged opposite to each other. The stability of connection between the connecting beams 121 and the substrate frame 110 is further enhanced. The two connecting beams 121 arranged opposite to each other are equivalent to a fixed beam arranged integrally. Two ends of a fixed beam are fixedly connected to two ends of the substrate frame 110, respectively, so that the middles of a plurality of fixed beams are connected in a staggered manner, thus further enhancing the connection strength of the entire vibrating diaphragm and the substrate frame 110, and ensuring that the substrate frame 110 can strengthen the entire vibrating diaphragm.

In a feasible embodiment of the present application, as shown in FIG. 2 and FIG. 3, the plurality of cantilever beams 122 are arranged between adjacent two of the connecting beams 121.

Specifically, the plurality of cantilever beams 122 are arranged between adjacent two of the connecting beams 121. In a process that a microphone device receives a sound, the entire vibrating diaphragm is fixed through the connecting beams 121. On the basis of ensuring the connection strength of the entire vibrating diaphragm and the substrate frame 110, the plurality of cantilever beams 122 are arranged between adjacent two of the connecting beams 121, improving the sensitivity of the piezoelectric MEMS microphone chip 100.

In a feasible embodiment of the present application, as shown in FIG. 2 and FIG. 3, the sound receiving beams 120 are of a piezoelectric unimorph r structure or a piezoelectric bimorph structure.

Specifically, when each of the sound receiving beams 120 is of the piezoelectric unimorph structure, the top electrode, the piezoelectric film, and the bottom electrode are provided in sequence from top to bottom.

Specifically, when each of the sound receiving beams 120 is a piezoelectric bimorph 130, the top electrode, a top piezoelectric film, a middle electrode, a bottom piezoelectric film, and the bottom electrode are provided in sequence from top to bottom. As shown in FIG. 4 to FIG. 12, firstly a 25 nm piezoelectric material is deposited on a high-resistance silicon substrate frame 110 to serve as a seed layer 131, then a bottom electrode 132 is deposited, a photoresist is subjected to spin-coating, and exposure and development are performed, to pattern the bottom electrode; a bottom piezoelectric film 133 is deposited, a middle electrode 134 is deposited, a photoresist is subjected to spin-coating, and exposure and development are performed, to pattern the middle electrode 134; atop piezoelectric film 135 is deposited, a top electrode 136 is deposited, a photoresist is subjected to spin-coating, and exposure and development are performed, to pattern the top electrode; an oxide layer is deposited to serve as a protective layer, a photoresist is subjected to spin-coating, and exposure and development are performed, to expose the top electrode 136; a photoresist is subjected to spin-coating, and exposure and development are performed, to expose the middle electrode 134; a photoresist is subjected to spin-coating, exposure and development are performed to expose the bottom electrode 132, and a beam structure is etched out; a photoresist is subjected to spin-coating, and exposure and development are performed; a lead electrode is deposited; and a back cavity is etched.

Figure 13:
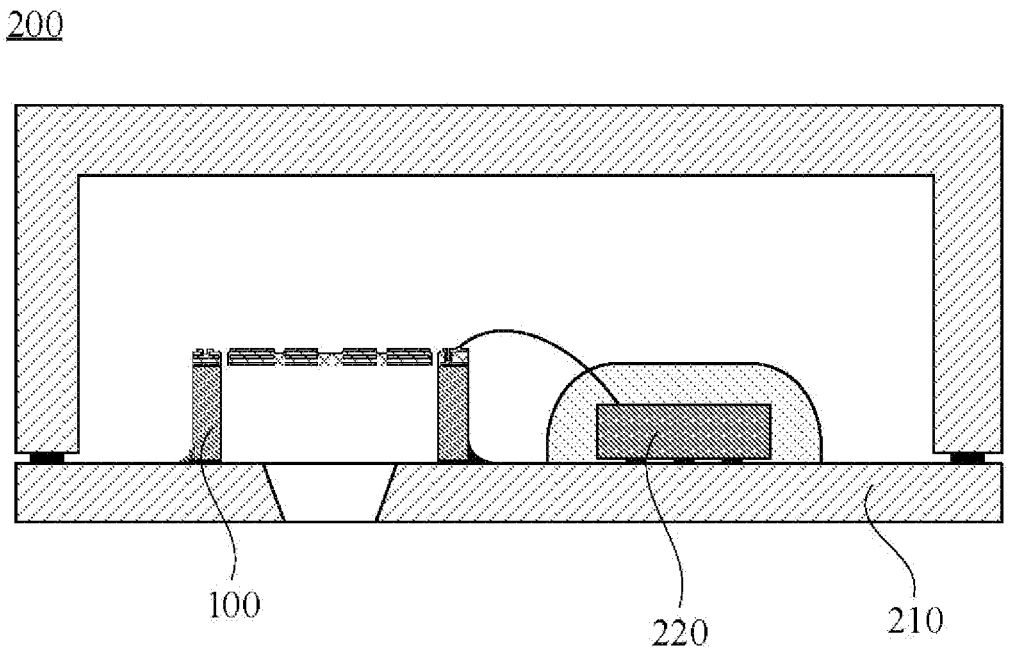
FIG. 13 is a schematic structural diagram of a piezoelectric MEMS microphone provided by an embodiment of the present application.

Referring to FIG. 13, an embodiment of the present application further discloses a piezoelectric MEMS microphone 200, including a substrate 210, an application specific integrated circuit (ASIC) chip 220 arranged on the substrate 210, and the piezoelectric MEMS microphone chip 100 in the above embodiment, where the piezoelectric MEMS microphone chip 100 is arranged on the substrate 210 and is connected to the ASIC chip 220 through at least one lead wire. The microphone contains the same structure and beneficial effect as the piezoelectric MEMS microphone chip 100 in the above embodiment. The structure and beneficial effects of the piezoelectric MEMS microphone chip 100 have been described in detail in the above embodiment, and will not be repeated herein.

The embodiments of the present application have the following beneficial effects:

The piezoelectric MEMS microphone chip and the piezoelectric MEMS microphone provided by the present application include the substrate frame and the plurality of sound receiving beams arranged on the substrate frame, where each of the sound receiving beams includes the connecting beam and the cantilever beam, the connecting beam and the cantilever beam are staggered on the circumference, one ends of the plurality of sound receiving beams that face the geometric center are fixedly connected to one another in the center defined by the substrate frame, and one end of the connecting beam that is away from the geometric center is fixedly connected to the substrate frame. The connecting beam adopts a working principle similar to that of a clamped-clamped beam, which greatly improves the utilization of the vibrating diaphragm area of the device and greatly increases the output of the device. Compared with a peripheral fixing mode, the cantilever beam in the present application has higher sensitivity. Compared with an intermediately fixed substrate frame, in the present application, the plurality of connecting beams are fixedly connected to the substrate frame, which can improve the fixing stability of the cantilever beams, and also enhances the output sensitivity of the piezoelectric microphone.

The above descriptions are only the preferred embodiments of the present application, and are not used to limit the present application. For those skilled in the art, the present application may have various modifications and variations. Any modifications, equivalent substitutions, improvements and the like made within the spirit and principle of the present application should be included within the scope of protection of the present application.

What is claimed is:

1. A piezoelectric micro electrical mechanical system (MEMS) microphone chip, comprising a substrate frame and a plurality of sound receiving beams arranged on the substrate frame, wherein the plurality of sound receiving beams are formed by means of etching an entire vibrating diaphragm, each of the sound receiving beams comprises at least one connecting beam and at least one cantilever beam, the connecting beam and the cantilever beam are staggered on a circumference, one ends of the plurality of sound receiving beams that face a geometric center of the a circumference are fixedly connected to one another in a center defined by the substrate frame, and one end of the connecting beam that is away from the geometric center is fixedly connected to the substrate frame, wherein electrodes are arranged on one side of the connecting beam that is close to an edge of the substrate frame and the other side of the connecting beam that is close to the geometric center, respectively, the electrodes on the two sides of the connecting beam are not connected to each other, and an electrode is arranged on one side of the cantilever beam that faces the geometric center.

2. The piezoelectric MEMS microphone chip according to claim 1, wherein sector angles formed by two side edges of each of the sound receiving beams that face the geometric center are same.

3. The piezoelectric MEMS microphone chip according to claim 1, wherein sector angles formed by two side edges of each of the sound receiving beams that face the geometric center are different.

4. The piezoelectric MEMS microphone chip according to claim 3, wherein sector angles formed by two side edges of each of the cantilever beams that face the geometric center are same, and sector angles formed by two side edges of each of the connecting beams that face the geometric center are same and are smaller than the sector angles formed by the two side edges of each of the cantilever beams that face the geometric center.

5. The piezoelectric MEMS microphone chip according to claim 3, wherein sector angles formed by two side edges of each of the plurality of cantilever beams that face the geometric center are different, and lengths of the plurality of cantilever beams are different.

6. The piezoelectric MEMS microphone chip according to claim 1, wherein a spacing distance between adjacent two of the connecting beams is equal.

7. The piezoelectric MEMS microphone chip according to claim 1, wherein the plurality of cantilever beams are arranged between adjacent two of the connecting beams.

8. The piezoelectric MEMS microphone chip according to claim 1, wherein the sound receiving beams are of a piezoelectric unimorph structure or a piezoelectric bimorph structure.

9. The piezoelectric MEMS microphone chip according to claim 4, wherein there are eight sound receiving beams, and sector angles formed by two side edges of a valve of each of the eight sound receiving beams that face the geometric center are same.

10. The piezoelectric MEMS microphone chip according to claim 9, wherein there are even numbers of connecting beams arranged opposite to each other in pairs.

11. The piezoelectric MEMS microphone chip according to claim 10, wherein there are four connecting beams and four cantilever beams, and the connecting beams and the cantilever beams are staggered.

12. The piezoelectric MEMS microphone chip according to claim 1, wherein the substrate frame is polygonal, and shapes of the plurality of sound receiving beams are trapezoids with a same area.

13. The piezoelectric MEMS microphone chip according to claim 1, wherein the substrate frame is circular, and shapes of the plurality of sound receiving beams are sectors with a same area.

14. The piezoelectric MEMS microphone chip according to claim 8, wherein the sound receiving beams are of the piezoelectric unimorph structure that comprises an upper electrode, a piezoelectric film, and a lower electrode in sequence from top to bottom.

15. The piezoelectric MEMS microphone chip according to claim 8, wherein the sound receiving beams are of the piezoelectric bimorph structure that comprises an upper electrode, an upper piezoelectric film, a middle electrode, a lower piezoelectric film, and a lower electrode in sequence from top to bottom.

16. A piezoelectric MEMS microphone, comprising a substrate, an application specific integrated circuit (ASIC) chip arranged on the substrate, and the piezoelectric MEMS microphone chip according to claim 1, wherein the piezoelectric MEMS microphone chip is arranged on the substrate and is connected to the ASIC chip through at least one lead wire.

17. The piezoelectric MEMS microphone according to claim 16, wherein the piezoelectric MEMS microphone chip comprises a substrate frame and a plurality of sound receiving beams arranged on the substrate frame, each of the sound receiving beams comprises a connecting beam and a cantilever beam, and sector angles formed by two side edges of each of the sound receiving beams that face a geometric center are same.

18. The piezoelectric MEMS microphone according to claim 16, wherein sector angles formed by two side edges of each of the sound receiving beams that face the geometric center are different.

19. The piezoelectric MEMS microphone according to claim 18, wherein sector angles formed by two side edges of each of the cantilever beams that face the geometric center are same, and sector angles formed by two side edges of each of the connecting beams that face the geometric center are same and are smaller than the sector angles formed by the two side edges of each of the cantilever beams that face the geometric center.

20. The piezoelectric MEMS microphone according to claim 18, wherein sector angles formed by two side edges of each of the plurality of cantilever beams that face the geometric center are different, and lengths of the plurality of cantilever beams are different.

* * * * *